US007314025B2

(12) United States Patent
Shkolnikov et al.

(10) Patent No.: US 7,314,025 B2
(45) Date of Patent: Jan. 1, 2008

(54) COMBUSTION POWERED FASTENER-DRIVING TOOL WITH INTERCONNECTED CHAMBERS

(75) Inventors: Yury Shkolnikov, Glenview, IL (US); Walter J. Taylor, McHenry, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/182,208

(22) Filed: Jul. 15, 2005

(65) Prior Publication Data

US 2007/0012267 A1 Jan. 18, 2007

(51) Int. Cl.
*F02B 71/00* (2006.01)

(52) U.S. Cl. ..... 123/46 H; 123/46 R

(58) Field of Classification Search ..... 123/46 H, 123/46 R

See application file for complete search history.

(56) References Cited

U.S. PATENT DOCUMENTS

RE32,452 E 7/1987 Nikolich
4,739,915 A * 4/1988 Cotta ..... 227/10
5,199,626 A 4/1993 Terayama et al.
5,799,855 A * 9/1998 Veoukas et al. ..... 227/10
5,897,043 A * 4/1999 Veoukas et al. ..... 227/10
6,019,072 A * 2/2000 Phillips et al. ..... 123/46 H
6,260,519 B1 * 7/2001 Phillips ..... 123/46 R

* cited by examiner

*Primary Examiner*—Stephen K. Cronin
*Assistant Examiner*—Jason Benton
(74) *Attorney, Agent, or Firm*—Greer, Burns & Crain, Ltd.; Lisa M. Soltis; Mark W. Croll

(57) ABSTRACT

A combustion tool has a housing with an air intake end and an opposite bumper end, a combustion-powered power source in the housing including a cylinder encircling a reciprocating piston associated with a driver blade, and having at least one air port located at the bumper end below the piston. At least one air intake is located adjacent the air intake end and is provided with an air filter. At least one air passageway is provided in fluid communication with the at least one air port and in operational relationship with the air filter.

16 Claims, 3 Drawing Sheets

COMBUSTION POWERED FASTENER-DRIVING TOOL WITH INTERCONNECTED CHAMBERS

BACKGROUND

The present invention relates generally to fastener-driving tools used to drive fasteners into workpieces, and specifically to combustion-powered fastener-driving tools, also referred to as combustion tools.

Combustion tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include inserting the fuel into the combustion chamber, mixing the fuel and air within the chamber and removing or scavenging combustion by-products. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures within the cylinder. Fasteners are fed magazine-style into the nosepiece, where they are held in a properly positioned orientation for receiving the impact of the driver blade.

An operational problem of conventional combustion-powered tools is that as air required for combustion enters the tool, due to the relatively dirty operational environment of such tools, dirt, dust and/or other debris, including but not limited to fragments of nail collation material, sawdust, wallboard particles and the like enters the tool, specifically the cylinder below the piston. This contaminated air enters mainly through air ports located below the exhaust ports as the piston returns to its pre-firing position after combustion. These air ports are typically located below or in close proximity to a shock-absorbing bumper located within the cylinder. Air cannot reenter through the exhaust ports due to the presence of one-way petal valves. Through prolonged tool operation, among other effects, these contaminants deteriorate tool lubricants required for smooth operation of the piston and movement of the reciprocating valve sleeve, the component used to close the combustion chamber.

Such tools typically have an air filter located at an upper end of the tool near the combustion chamber fan air intake. However, this filter has been designed to filter air entering the combustion chamber and has no effect on the air located below the piston in the cylinder, where contaminant-caused damage has been known to occur. It has been previously difficult to place a filter in the tool for removing contaminants from air located below the piston because of space considerations, and due to relatively high operational temperatures (in the order of 300° F.) which degrade many filter materials. Also, the size of any such filter would necessarily be relatively large to permit the passage of sufficient air to maintain proper air circulation within the tool. As such, space, material and tool operational factors combine to discourage tool designers from placing a filter on the tool to filter the air in the cylinder below the piston.

Thus, there is a need for a combustion-powered fastener-driving tool in which air located below the piston is filtered to remove contaminants encountered in the course of normal tool operation. There is also a need for such a filter which can withstand tool operational temperatures, and which maintains acceptable tool air circulation patterns.

BRIEF SUMMARY

The above-listed needs are met or exceeded by the present air passageway for a combustion-powered fastener-driving tool. Preferably, the present air passageway takes the form of at least one interconnection tube. One end of each present tube is placed in fluid communication with the air in the cylinder below the piston. This air is typically forced out of the tool as the driver blade is driven towards the workpiece for driving a fastener. In many such tools, this location is in the vicinity of the piston bumper, and where a lower end of the tool housing meets an upper end of the nosepiece.

An opposite end of the tube is placed in fluid communication with a filter, preferably the fan motor filter located at the upper end of the tool opposite the workpiece contact element. Alternately, the opposite end of the tube is placed in fluid communication with a separate, preferably supplementary filter, also preferably located remotely from the lower end of the tool housing. In this arrangement, during combustion, the downward movement of the piston will force air into the tube and out the filter, providing a filter cleaning function. As the piston returns to its pre-firing position, air will be drawn into the cylinder below the piston through the tube. This incoming air will have passed into the tool through the filter, thus removing many contaminants.

More specifically, a combustion tool has a housing with an air intake end and an opposite bumper end, a combustion-powered power source in the housing including a cylinder encircling a reciprocating piston associated with a driver blade, and having at least one air port located at the bumper end below the piston. An air intake is located adjacent the air intake end and is provided with an air filter. At least one air passageway is provided in fluid communication with the at least one air port and in operational relationship with the air filter.

In another embodiment, a combustion tool includes a combustion-powered power source having an air intake end and an opposite bumper end, defining a cylinder encircling a reciprocating piston associated with a driver blade, and having at least one air port located at said bumper end below said piston. At least one air intake is provided with an air filter. An air passageway is in fluid communication with the at least one air port and in fluid communication with the air filter for creating a bi-directional air flow between the at least one air port and the at least one air intake during tool operation. The at least one air intake includes a first filtered air intake associated with providing air into a combustion chamber, and a supplemental filtered air intake for supplying air to the passageway and receiving air from the bumper end during tool operation.

DETAILED DESCRIPTION

Figure 1:
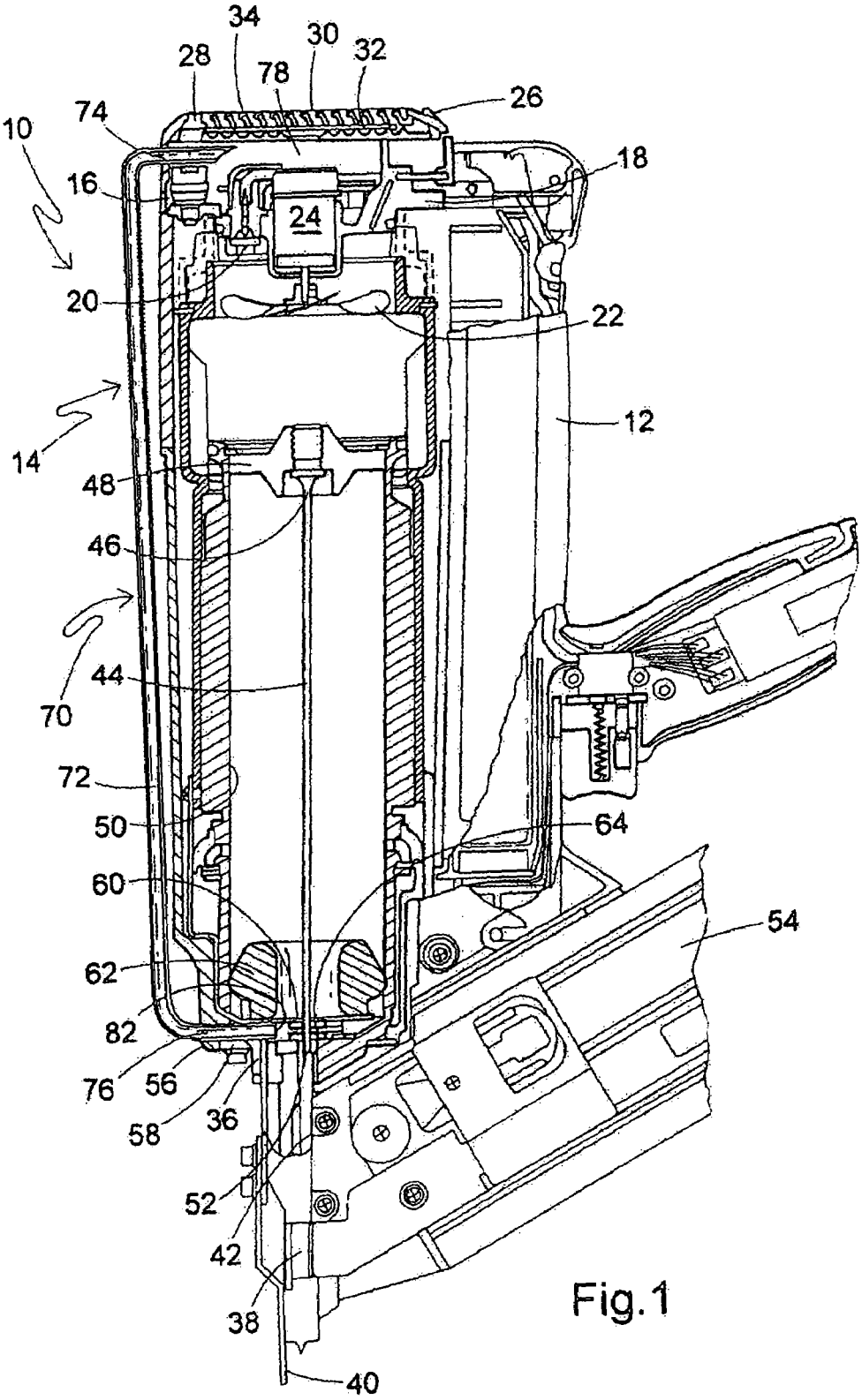
FIG. 1 is a vertical section of a combustion-powered fastener-driving tool incorporating the present interconnection tube.

Referring now to FIG. 1, a combustion-powered fastener-driving tool suitable for use with the present inventive air passageway is generally designated 10 and preferably incorporates the teachings of the patents referred to above and incorporated by reference herein. However, the present system is considered suitable for many types of combustion-powered fastener-driving tools having a variety of configurations, and not all of the illustrated tool components are described herein as not being directly related to the present air passageway in its various embodiments.

A main housing 12 is typically provided in a single piece, in two clamshell-type halves or equivalent configurations as is known in the art, and encloses a combustion power source, generally designated 14. At an upper end 16 of the housing 12, the power source 14 is provided with a cylinder head 18 supporting a spark plug 20 and preferably a fan 22 powered by a fan motor 24 as is known in the art. The power source 14 also includes a combustion chamber and a cylinder, described below.

Included on the housing 12 is a cap 26 that closes the upper end 16 of the housing and defines an air intake end 28 with an air intake 30 in the cap. An air filter 32 is associated with the 30 as is known in the art and is supported by a protective slatted grille 34. As is well known in the art, the air filter 32 is releasably secured to the cap 26. The air filter is made of a porous material such as plastic or metal mesh, foam or the like that is designed to allow the passage of air into the housing 12, but prevent the ingress of construction debris, dirt and other operational contaminants.

Opposite the upper end 16, a lower end 36 of the tool 10 includes a nosepiece 38 secured to the power source 14 and having a workpiece contact element 40 axially reciprocating relative thereto. A driver blade passageway 42 in the nosepiece 38 slidingly accommodates a driver blade 44 secured at an upper end 46 to a piston 48. A cylinder 50 is located in the power source 14 and defines a tubular track for the piston 48. A lower end 52 of the driver blade 44 is configured for engaging fasteners (not shown) fed into the nosepiece 38 through a magazine 54 and driving them into a workpiece as is well known in the art.

A bumper end 56 of the housing 12 also defines an end of the power source 14. An endplate 58 defines a central aperture 60 through which the driver blade 44 passes, as well as air when the piston 48 reciprocates during operation. Thus, the central aperture 60 may also be termed an air port, however it is also contemplated that other air ports may be provided in the end plate 58 or in lower portions of the cylinder 50. A resilient bumper 62 is located at the bottom end of the cylinder 50 as is known in the art for absorbing the impact of the piston 48 at the end of the combustion stroke. A seal 64 such as a wiping seal or equivalent is located at a lower end of the air port 60 just above an upper end of the nosepiece 38 for preventing air from entering the air port from the outside, thus preventing dirt digestion of the tool, while permitting relative sliding action of the driver blade 44.

An important feature of the present tool 10 is the provision of at least one air passageway, generally designated 70, in fluid communication with the at least one air port 60 and in operational relationship with the air filter 32. The at least one air passageway 70 creates bi-directional fluid communication (the preferable fluid being air) between the lower end of the cylinder 50 and the air filter 32, as well as the air intake 30. While in the preferred embodiment the air filter 32 is provided for filtering air entering the combustion chamber, it is also contemplated that additional or dedicated air filters and associated air intakes may be provided which are provided specifically for connection to the passageway 70. For clarity, only the filter 32 will be presently described.

Thus, substantially all of the air entering the cylinder 50 as the piston 48 returns to the pre-firing position shown in FIG. 1 must first pass through the filter 32. Also, substantially all air forced out the air port 60 during the combustion cycle flows out through both the filter 32 and the air intake 30.

In the preferred embodiment, the passageway 70 is provided in the form of at least one tube, also referred to as an interconnection tube, having a central section 72 generally parallel with an operational axis of the piston 48, and upper and lower ends 74, 76 preferably projecting at generally right angles to the central section formed as radiused bends for effecting connection respectively to the air intake and the at least one air port 60. The specific angular orientation of the upper and lower ends 74, 76 may vary to suit the situation. While depicted as at least one continuous tube, it is also contemplated that the passageway 70 may be defined by tubular segments joined by fixed angle fittings.

More specifically, the upper end 74 is preferably secured within an air chamber 78 defined by the cap 26 below the air filter 32 and the cylinder head 18. Conventional techniques for securing the upper end 74 are contemplated, including but not limited to friction fit, chemical adhesives, clips, rigid fittings or the like. While depicted outside the main housing 12 for clarity, it is preferred that the central section 72, and at least a majority of the upper and lower ends 74, 76 of the passageway 70 extends inside the main housing 12 along the combustion power source 14. It is contemplated that the passageway 70 may be secured to internal tool components as necessary for support or to enhance performance. If necessary, the main housing 12 can be radially extended to encompass the passageway 70. The passageway 70 is preferably manufactured of a tubing of sufficient durability to withstand the potential impacts and/or temperatures typically experienced by combustion-powered fastener driving tools.

At the lower end 76, the passageway 70 is placed in fluid communication with the at least one air port 60. The lower end 76 is ultimately secured to a bottom portion of the cylinder 50 and may pass through the housing 12, the end plate 58 or other structure on the tool to maintain this fluid communication. Similar fastening techniques described above relative to the upper end 74 are employable for securing the lower end 76 in position. An important consideration is that an opening 82 in the lower end 76 be in close fluid communication with the air port 60, regardless of the particular location of the air port on the tool 10.

It will be seen that with the provision of the seal 64, the air port 60 is in essentially sealed fluid communication with the passageway 70, such that substantially all of the air generated in combustion which is forced down the cylinder 50 by the piston 48 will pass through the air port and into the passageway. Also, it is preferred that the passageway 70 be of sufficient diameter to accommodate the free passage of substantially all of the air forced out the air port 60 by the piston 48 during its normal combustion cycle, as well as draw incoming air from the environment as the piston returns to the pre-firing position. This diameter will vary depending on the type of tool and the size of the combustion power source 14.

Figure 2:
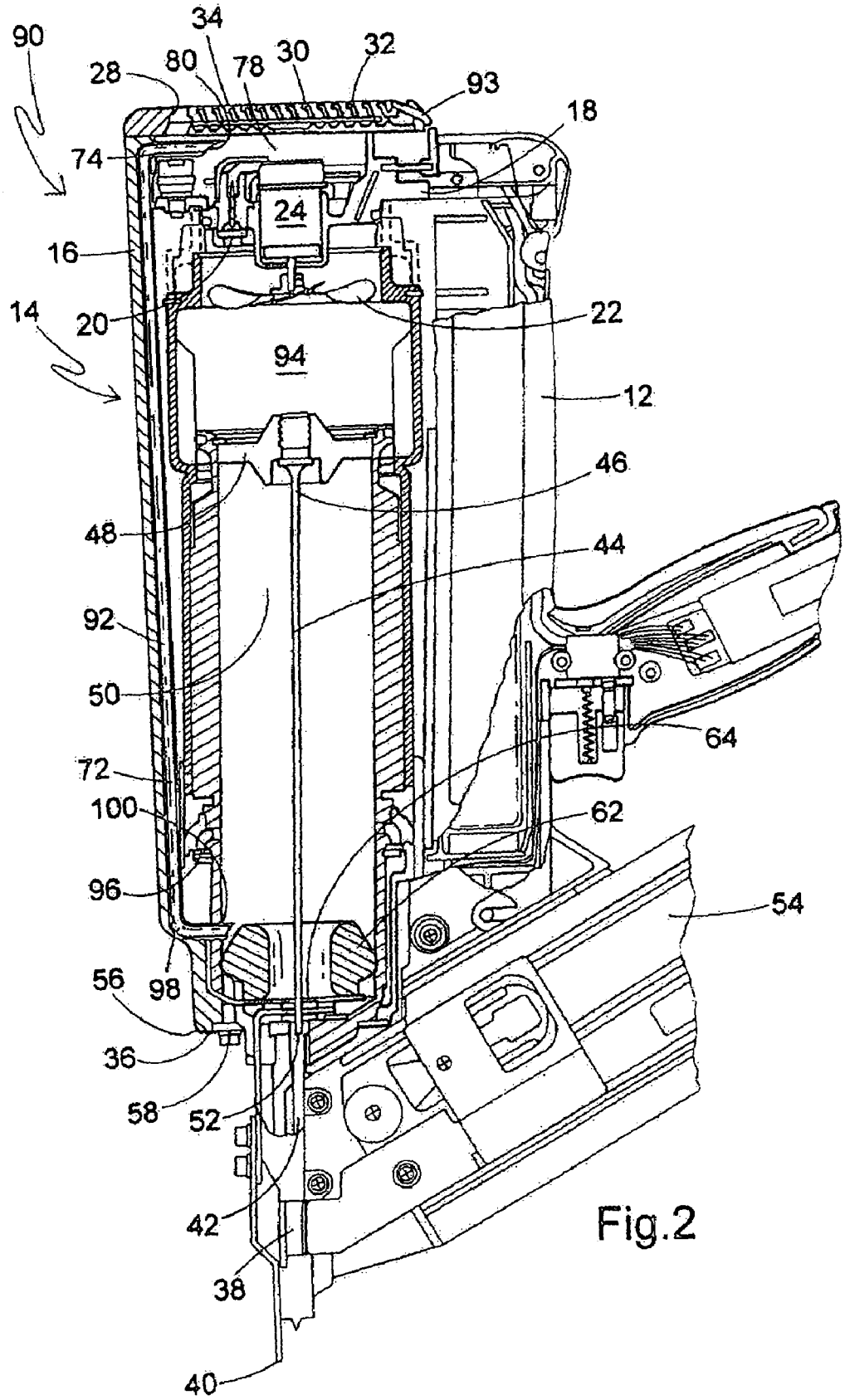
FIG. 2 is a vertical section of an alternate embodiment of the tool of FIG. 1 showing the tube as part of the housing.

Referring now to FIG. 2, an alternate embodiment of the tool 10 is generally designated 90. Shared components with the tool 10 are designated with identical reference numbers. While it is contemplated that most, if not all of the components of the tools 10 and 90 can be interchanged, a significant distinction between the tools 10 and 90 is that in the tool 90, instead of being a separate component, the passageway 70, now designated 92, is integrally incorporated within and is preferably formed with, the main housing 12. As is the case with the passageway 70, the passageway 92 is in fluid communication with at least one air port 60 and also with the at least one air filter 32 for creating a bi-directional air flow between the air port and the at least one air intake 30 during tool operation. As is the case with the passageway 70, if necessary, it is contemplated that the passageway 92 is secured to internal tool components for additional support.

In operation, both embodiments 10 and 90 operate in the same manner. During the firing cycle, a combustion chamber 94 is closed and separated from the air chamber 78. After combustion, the piston 48 moves downward in the cylinder 50 towards the bumper 62. Air from the cylinder 50 located below the piston 48 escapes partially through an exhaust valve 96 and partially through the air port 60. The exhaust valve 96 is a petal type or other one-way flow structure for preventing air intake, but in fluid communication with ambient in both embodiments 10 and 90. After the piston 48 passes below the exhaust valve 96, the air escapes primarily through the air port 60, which now travels through the passageways 70, 92 and cleans the filter 32 of accumulated debris by pressurized reverse flow of air.

Another difference between the embodiments 10 and 90 is that a lower end 98 of the passageway 92 is in fluid communication with at least one air port 100 located in the side of the cylinder 50 near the bumper 62. In this version, the air port 60 in the end plate 58 has been eliminated, so that air remaining in the cylinder 50 as the piston 48 passes below the exhaust valve 96 is forced out the air port 100. Only one air port 100 is shown for clarity, however it is contemplated that multiple ports 100 are provided, preferably with multiple passageways 92.

During the return cycle, the piston 48 and the driver blade 44 move upward, driven by differential gas pressure, and the vacuum created in the combustion chamber 94 and the cylinder 50. Outside air now enters the cylinder 50 primarily through the passageways 70, 92, which are now filtered. Since the air filter 32 is located remotely from the relatively hot cylinder 50, it is not subjected to high operational tool temperatures.

Figure 3:
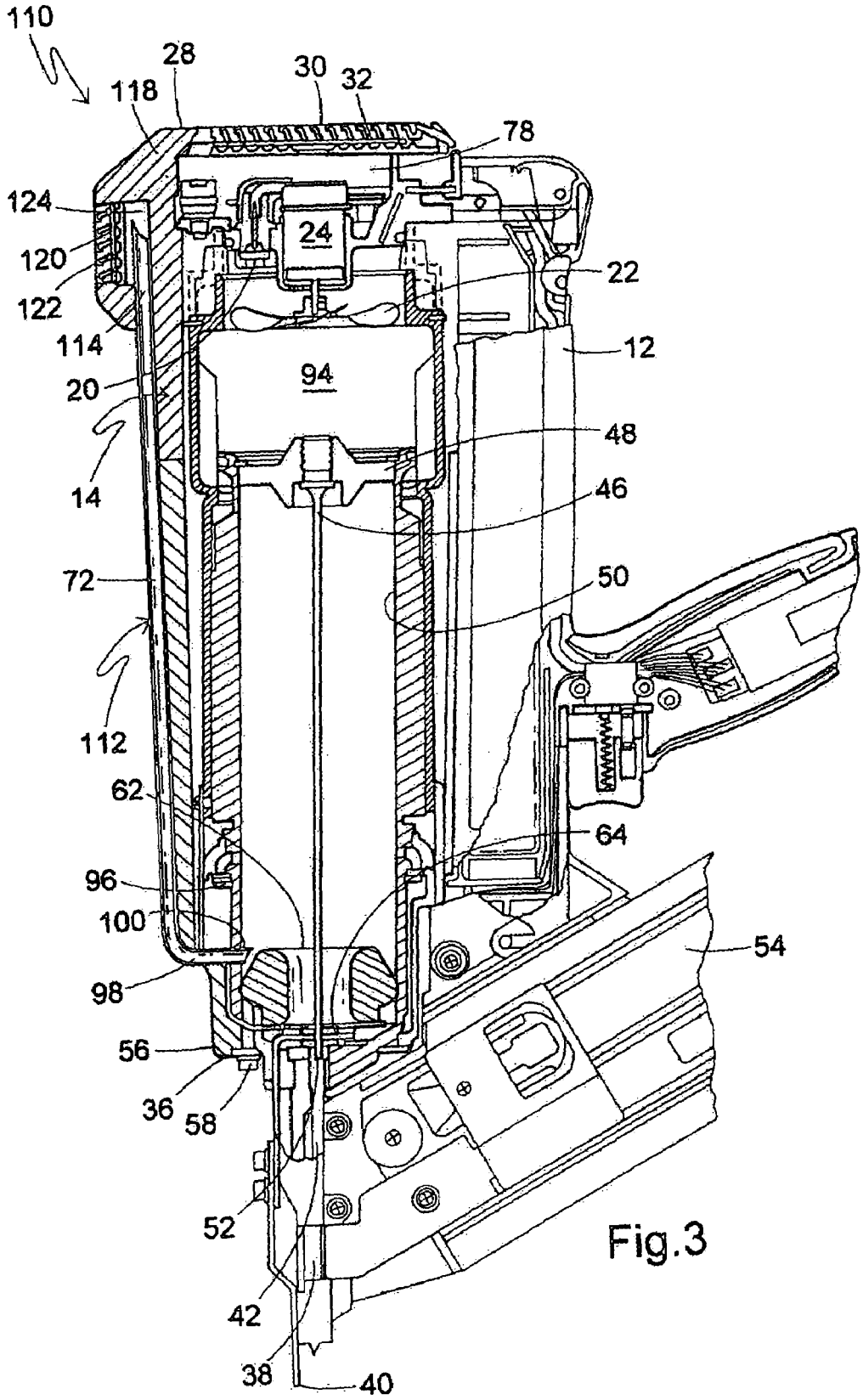
FIG. 3 is a vertical section of an alternate embodiment of the tool of FIG. 2 showing the tube part of the housing and being in communication with a dedicated air filter.

Referring now to FIG. 3, another embodiment of the present tool is generally designated 110, and shared components with the tools 10 and 90 are designated with identical reference numbers. Also, it is contemplated that the construction of the passageway 70, 92, and the positioning of the air ports 60, 100 may be interchanged with that disclosed in FIG. 3 to suit the situation. As is the case in the tool 90, in the tool 110 a passageway is generally designated 112 and is integrally formed with the housing 12.

A main difference between the tool 110 and the tools 10 and 90 is that an upper end 114 of the passageway 112 is not in communication with the air intake 30, but is in fluid communication with at least one supplemental air intake 116 located in a specially reconfigured upper end 118 of the main housing 12. However, both the air intake 30 and the supplemental air intake 116 are preferably located at or adjacent the air intake end 28. The supplemental air intake 116 is preferably provided with its own filter 120, protective grille 122 and a supplemental chamber 124 with which the upper end 114 is in fluid communication. In some applications, it is contemplated that the filter 120, the protective grille 122 and the chamber 124 would be eliminated. It is also contemplated that the at least one supplemental air intake 116 may be located on the main housing in any suitable location which is satisfactorily remote from the relatively high operational temperatures of the combustion power source 14.

While the upper end 114 of the passageway 112 is shown as a vertically projecting extension of the central portion 72, other angular orientations or other configurations are contemplated as long as fluid communication with the air port 100, 60 is maintained. Also, as is the case with the tools 10 and 90, while the passageway 112 is shown on a periphery of the housing 12, an internal disposition is also contemplated. Also, while the lower end 98 of the passageway 112 is shown in communication with the cylinder 50 through the port 100, it is also contemplated that the passageway 112 could be in communication with the air port 60 as shown in FIG. 1. The operation of the embodiment 110 is substantially the same as described above in relation to the embodiments 10 and 90, with the primary difference being that the chamber 124 does not also supply air to the combustion chamber 94.

While a particular embodiment of the present combustion-powered fastener-driving tool with interconnected chambers has been described herein, it will be appreciated by those skilled in the art that changes and modifications may be made thereto without departing from the invention in its broader aspects and as set forth in the following claims.

The invention claimed is:

1. A combustion tool, comprising:

a housing having an air intake end and an opposite bumper end;

a combustion-powered power source in said housing including a cylinder encircling a reciprocating piston associated with a driver blade, and having at least one air port located at said bumper end below said piston;

at least one air intake located on said housing and being provided with an associated air filter; and at least one air passageway in fluid communication with said at least one air port and in operational relationship with said air filter.

2. The tool of claim 1 wherein said housing encloses said power source and defines a filter chamber at said air intake end, said passageway being in fluid communication with said air filter chamber.

3. The tool of claim 1 wherein said at least one air filter is adjacent said air intake end.

4. The tool of claim 1 wherein said at least one air passageway is a tube.

5. The tool of claim 4 wherein said tube is integrally formed in said housing.

6. The tool of claim 1 wherein said air passageway is an interconnection tube which is separate from said housing.

7. The tool of claim 1 wherein said at least one air passageway creates bi-directional air flow between said at least one air filter and said at least one air port.

8. The tool of claim 1 wherein said at least one passageway is at least one interconnecting tube having a central section generally parallel with an operational axis of the piston, and upper and lower ends projecting at generally right angles to said central section for effecting connection respectively to said at least one air intake and said at least one air port.

9. The tool of claim 8 wherein said at least one air port is in at least one of the cylinder and an endplate.

10. The tool of claim 1 further including a seal for preventing air from entering the cylinder below said bumper end.

11. A combustion tool, comprising:

a combustion-powered power source having an air intake end and an opposite bumper end, defining a cylinder encircling a reciprocating piston associated with a driver blade, and having at least one air port located at said bumper end below said piston;

at least one air intake being provided with an air filter;

an air passageway in fluid communication with said at least one air port and in fluid communication with said air filter for creating a bi-directional air flow between said at least one air port and said at least one air intake during tool operation; and said at least one air intake including a first filtered air intake associated with providing air into a combustion chamber, and a supplemental filtered air intake for supplying air to said passageway and receiving air from said bumper end during tool operation.

12. The tool of claim 11 further including at least one exhaust port near said bumper end, and wherein said air passageway is constructed and arranged to receive substantially all air forced by said piston down said cylinder below said at least one exhaust port.

13. The tool of claim 11 further including a seal located in a driver blade passageway for preventing air from escaping from said cylinder down said driver blade passageway.

14. The tool of claim 11 wherein said air intake and said supplemental air intake are both located on or adjacent said air intake end.

15. The tool of claim 11 wherein said at least one air port is located in at least one of the cylinder and an endplate.

16. A combustion tool, comprising:

a combustion-powered power source having an air intake end and an opposite bumper end, defining a cylinder encircling a reciprocating piston associated with a driver blade, and having at least one air port located at said bumper end below said piston;

at least one air intake being provided with an air filter;

an air passageway in fluid communication with said at least one air port and in fluid communication with said air filter for creating a bi-directional air flow between said at least one air port and said at least one air intake during tool operation; and said at least one air intake including a first filtered air intake associated with providing air into a combustion chamber, and a supplemental air intake for supplying air to said passageway and receiving air from said bumper end during tool operation.

* * * * *